US005685472A

United States Patent [19]

Borel

[11] Patent Number: 5,685,472

[45] Date of Patent: Nov. 11, 1997

[54] FEEDING DEVICE FOR PROCESSING A CONTINUOUS MOVING WEB IN A STATION IN WHICH THE WEB IS ACTED ON WHILE IN A STANDSTILL POSITION

[75] Inventor: Edouard Borel, Corcelles/Chavornay, Switzerland

[73] Assignee: Bobst SA, Lausanne, Switzerland

[21] Appl. No.: 647,022

[22] Filed: May 8, 1996

[30] Foreign Application Priority Data

May 8, 1995 [CH] Switzerland ..... 01305/95

[51] Int. Cl.[6] ..... B65H 20/24; B65H 20/00

[52] U.S. Cl. ..... 226/114; 226/119; 226/160; 226/194

[58] Field of Search ..... 226/158, 160, 226/188, 189, 194, 113, 114, 118, 119, 180

[56] References Cited

U.S. PATENT DOCUMENTS

| | | | |
|---|---|---|---|
| 3,058,683 | 10/1962 | Wahlström | 226/114 |
| 3,892,344 | 7/1975 | Corse | 226/114 |
| 4,060,187 | 11/1977 | Grob . | |
| 4,863,086 | 9/1989 | Armelin . | |
| 5,163,595 | 11/1992 | Messner | 226/160 |
| 5,197,645 | 3/1993 | Nordlof | 226/160 |

FOREIGN PATENT DOCUMENTS

| | | | |
|---|---|---|---|
| 2149483 | 4/1973 | Germany | 226/114 |

OTHER PUBLICATIONS

"Machine 'Stops'Roll Labels Momentarily for High–Speed Die–Cutting", *Ingenious Mechanisms,* Industrial Press, Inc. 1969, Chapter 14, pp. 313–315.

*Primary Examiner*—Daniel P. Stodola
*Assistant Examiner*—Matthew A. Kaness
*Attorney, Agent, or Firm*—Hill, Steadman & Simpson

[57] ABSTRACT

A feed device for advancing a web into a processing station which acts on the web while the web is in a standstill position. The feeding device includes a first drive roller around which a second swivel roller oscillates between an upstream and downstream position to create a loop to take up the web during a dwell in the movement of the web through the processing station. The swivel roller is driven at the same speed as the drive roller by an arrangement of drive pinion and a counterweight is also rotated at the same rate by a gear arrangement. The counterweight is mounted on a lever which will oscillate in an opposite direction to the movement of the swivel roller so that the moment of inertias are balanced during operation of the device and the torque on the drive for the rollers is balanced.

12 Claims, 6 Drawing Sheets

FEEDING DEVICE FOR PROCESSING A CONTINUOUS MOVING WEB IN A STATION IN WHICH THE WEB IS ACTED ON WHILE IN A STANDSTILL POSITION

BACKGROUND OF THE INVENTION

The present invention is directed to a feeding device for processing a continuous moving web in a station of a machine comprising several successive processing stations, which web is in a standstill or dwell position when being processed. A station for processing the web, while in a standstill or dwell position, could be a platen press for printing and/or cutting.

Since the platen press is a station of a machine that needs to allow the web to be temporarily stopped during the printing or cutting operation, an accumulation of the web in the shape of an upstream loop may occur due to the continuous feed of the web. The function of the feeding device is to create cyclically and to permanently control the loop, which increases during the dwell period for processing of the platen press, and which decreases as soon as the feeding of the press restarts in view of the subsequent operation. These operations are enacted cyclically. Such a feeding device is necessary by the fact that from a certain naming speed of the web, a float or flutter of the loop creates defaults of positions of the web within the press. To this aim, several feeding devices have been conceived now and henceforth.

U.S. Pat. No. 4,060,187, whose disclosure is incorporated herein by reference thereto, describes a feeding device comprising two circular plates which are mounted adjacent side walls of the frame and rotate on a first axis. A cylinder or roll around which the web passes is fitted between the two plates according to a second rotating axis eccentric with regard to the first axis. The rotation of the plates pulls the roller and web down cyclically in order to make a loop according to a pseudo-sinusoidal function. Counterweights are mounted diametrically opposite the roller on the plates as well. Because the stopping time at the maximum of the loop is relatively short, a correction in advance, which is in arrears of the angular position of the bearings keeping the roller in the rotating plates, is foreseen at this level, which correction will prolong the time. A screwing device allows for modifying the eccentricity of the roller and the counterweights, hence the length of the loop with regard to the cutting or printing size.

While this device functions satisfactorily, it is proved, however, that the complexity of the device of the adjustment of the eccentricity and of correction of the angular position at the low point, implicating the presence of numerous heavy parts, prevents an increase in the feeding rate of the web above a certain value. Effectively, a simple reinforcement of each part, which increases as much their inertia and weight, is no more sufficient to keep the acceleration in play, and vibration phenomenons detrimental to the precision of the registry of the web appear within the platen press.

Moreover, initial minor variations of the tension of the web induced by such a type of feeding device are amplified as well when accelerating the rate of feed, which will affect the register precision as well.

Moreover, the removing speed of the cylinder being variable, noticeably by its correction of the position at the low point, the required torque to start up this feeding device is not regular. This irregularity increases with the rate of feed or tempo. Therefore, it is impossible to use performant electric motors, such as of brushless type. Finally, this complex device is very expensive to construct.

Another type of feeding device comprises a first drive cylinder, also named "appeal cylinder" or "sensitive control", around which runs a second swivel cylinder mounted on two sidewise levers pivoting on the axis of the drive cylinder, first upstream in order to temporarily increase the run of the web, what will stop the part of the web under the downstream platen, then downstream in order to introduce very quickly the following part of the web.

In order to coordinate the rotating speeds of the two cylinders and to avoid slipping of the web, driving pinions of the swivel cylinder are geared with a toothed gear of the same dimension associated with the axle of the drive cylinder. The absence of slipping will avoid any affect on the printing in the case of the printed web, which is in touch with the swivel cylinder by its printed side, and this absence keeps the relative positioning of the web within the platen press with regard to other upstream stations.

The document "Ingenious Mechanisms" published in 1969 by Industrial Press Inc. describes, in paragraph 14, a feeding device of such a type in which the swivel cylinder arranged under the web and above the drive cylinder oscillates perceptibly in a horizontal plane in order to make a loop which develops backward. The tension in the web is kept by a second pair of drive and swivel cylinders arranged downstream of the platen press and oscillating in synchronism owing to a common lower pull rod. However, this feed device requires a double pair of cylinders and a complex simultaneous driving mechanism and, thus, the feed device has been rapidly given up since it was impossible to increase its rate of feed.

U.S. Pat. No. 4,863,086, whose disclosure is incorporated herein by reference thereto and which claims priority from the same French Application as European 305 230, describes another feeding device in which a swivel roller or cylinder is arranged downstream and above a web and oscillates in an oblique plane oriented down under the drive roller or cylinder in order to make a loop which develops upside down. The tension in this web is kept at the entry of the platen press by means of a "slipping" cylinder or roller, i.e., a cylinder running at high speeds, and against which the web is kept by an aspiration due to radial ducts extending through an external surface of the cylinder to an internal box, which is a suction or vacuum box which has an expanse that corresponds to the surface of contact.

However, this rotative depression cylinder is not much more reliable at high speed, and its maintenance is delicate. Moreover, within this feeding device, the web is left to itself on a long distance between the oscillating cylinder and the slipping cylinder, which distance allows important floating, fluttering or undulating as the tempo or rate of feed increases.

Particularly, it appears a little variation in the torque required at the general feeding of such a type of feeding device when the pinion of the swivel roller or cylinder is running in one direction and then in the other along a toothed wheel associated with the axle of the drive cylinder or roller. This variation excludes the use of a performance electric motor with constant torque.

Moreover, the cyclical upstream launching of the swivel cylinder roller, either down or up in order to stop the downstream web, induces a forward constraint in the frame, followed then immediately by a backward constraint, wherein the swivel roller or cylinder returns to its initial position. Thus, the forces reciprocating in the horizontal plane increase very rapidly with the increased rate of feed and generate vibrations directly prejudicial on the correct registration of the web in the platen and cause a premature fatigue of the parts, noticeably of the bearings.

SUMMARY OF THE INVENTION

The object of the present invention is to provide a feeding device for processing a web in a station, which station has the web in a standstill position arriving from an upstream station in a continuous moving manner, and which device has to be able to support an important rate of feed, for instance greater than 350 cycles in a minute, while securing a high precision of the standstill position of the web within the station or platen of about 1/10 of a millimeter. Notably, the structure and the arrangement of the constituent parts of this device have to be relatively simple in order to accordingly reduce the cost of manufacture and to allow for a minimized perceptibility of the vibrations in the vertical plane and a fluttering of the web.

These objects are achieved in a device comprising a first drive cylinder or roller around which a second swivel cylinder or roller oscillates upstream and then downstream, said swivel roller being fitted on two lateral levers pivoting on the axle of the drive roller, the driving pinions of the swivel roller being geared with a toothed gear of the same diameter associated with the axle of the drive roller (along which gear the pinion is running on oscillations of the swivel roller), by the fact that it comprises, moreover, a counterweight carried in rotation from the toothed gear on the axle, said counterweight being fitted on an arm pivoted around the axle of the drive roller and connected by a lever mechanism in order to oscillate in the operation direction from that of the swivel roller.

Preferably, the pinion of the counterweight has an identical diameter to the one of the toothed gear of the axle with which it is meshing as well, and the counterweight has moments of inertia with regard to the axis of the central rotation and with regard to the axis of the identical arm with those of the swivel roller.

Advantageously, one of the levers keeping the swivel roller comprises a toothed segment in the shape of a circular sector, aligned on the axis of the drive roller and geared with a first toothed gear or pinion associated with a reversing axle extending parallel to the axis of the drive roller, a second toothed gear or pinion associated with the reversing axle being geared to a reversing gear which, in turn, is geared to a circular toothed sector of a pivot arm carrying the counterweight. This relatively simple mechanism allows a provision of the arm and the counterweight to oscillate exactly in the opposite direction to the levers and swivel roller.

Preferably, the swivel roller is arranged above the drive roller and oscillates in a plane perceptibly horizontal in order to perfect the potential length of the stopped web. The web travels then below the drive roller and leaves above the swivel roller.

Then, as seen from the "driving side", for example the sidewise left view of FIG. 1 with regard to the travelling direction of the web, if the drive roller turns in a clockwise direction, the swivel cylinder or roller turns in the opposite direction. When the swivel cylinder or roller is pulled upstream, its pinion runs in a clockwise direction along the toothed gear of the axle of the drive roller and reduces momentarily the torque of the swivel roller. Inversely, the counterweight pinion, turning also in an anti-clockwise direction, runs in an anti-clockwise direction along the toothed wheel as well and momentarily increases the driving torque, compensating for the loss of the torque of the swivel roller. The driving torque at the entry of the device is then practically constant.

According to a preferred realized mode, the counterweight oscillates in the same horizontal plane as the swivel roller and realizes, moreover, a compensation of the constraints or forces acting upstream and downstream of the device on the frame.

In other words, the unusual adjunction of the rotative counterweight at the end of an oscillating arm, this whole arrangement simulates a second swivel cylinder moving in the opposite direction and allows a re-use of the combination of the drive roller and swivel roller in order to make a loop, but at rates of feed distinctly more important. The advantages kept by this device according to the invention is that the act of feeding of the web comprises an acceleration phase in which the value and variations instantaneous of the acceleration are controlled, notably in order that at the starting of the web, which is a critical phase because of the parting of the web from the tool of the platen press has to be secured, and this acceleration and variations have a low value and that the acceleration increases then progressively.

According to a first realized mode of the device of leading the web from the swivel roller to the processing station, a pressure cylinder or several pressure cylinders are installed from the axle of the swivel cylinder through elastic means in order to press the web of the material against the swivel roller with a predetermined pressure, at a position near the departure line of the web off of the swivel roller. This device secures an effective thrust of the web when feeding of the platen press on the occasion of the decreasing of the loop by a downstream movement of the swivel roller.

Usefully, the device also comprises a telescopic table leading the web between the exit of the oscillating swivel roller and the entry into the station processing the web in a standstill position. The table or tablets comprise a pair of downstream horizontal combs almost stationarily arranged one above the other and fastened in rotation at the entry of the processing station and a pair of upstream horizontal combs including oscillating upper and lower combs arranged at an exit of the swivel roller so as to be at the same level as the upper tangent from the roller. These movable combs are fastened in rotation around an axis of the swivel roller, the upstream oscillating upper and lower combs being respectively kept in sliding motion, for example by rails or sliding pieces, in an extension of corresponding downstream stationary combs, and this with their teeth offset sidewise.

According to a first alternative of the structure of the table, the upstream combs are respectively kept by an upper crossbar and a lower crossbar associated with a pair of sidewise rails, whose downstream ends are mounted in rotation near the entry of the processing station and whose upstream ends are engaged in external wheels mounted on two sidewise plates pivoting on the axle of the swivel roller. The upstream combs are then kept by a vertical pair of full crossbars or tubes associated with the sidewise or lateral plates.

Thus, the pressure rollers are mounted between two lateral horizontal levers respectively articulated on each oscillating side plate, one or one pair of side plate vertical cylinders fitted also against the plate making a predetermined force of pressure on the levers.

According to another alternative of the table design, the combs are confined in two half-boxes, one box being almost stationary and fastened to the entry of the processing station and the other oscillating box fastened in rotation to an axle of the swivel roller which embodies, the teeth of the lower comb being carried individually by vertical plates emerging orthogonally at the bottom of the boxes with the teeth of the upper comb being carried by vertical plates or tubes descending from the top of the box, the interpenetration of these plates or tubes forming lengthwise chambers opening on the bottom of each respective box in a crosswise or transverse chamber having sidewise windows. In this alternative, the air flow generated by the intermittent displacement of the web and the combs is channelized in a horizontal plane in order to avoid the urging of the web into frictional engagement against the upper or lower combs.

According to a second realized mode of the device for leading the web from the swivel roller to the processing station, the second mode comes alternatively or as complement to the first realized mode, one vertical pair of traction rollers is fitted near the entry of the following processing station, such as a platen press which is in a standstill position and is at the exit of the telescopic tablet, in order to feed the web with a right tension into the station.

A driving device of one of the traction rollers, especially well coupled with the feeding device described before, comprises a belt running around a pulley associated with the traction roller as well as around two disks which have the same diameter and are arranged respectively on each of the two legs of a vertical lever mounted for free rotation on the axle of the drive roller. The upper disk is associated with the axle of transmission of the swivel roller, which axle of transmission extends through the upper leg of the lever and provides the lever with the oscillation of the swivel roller. The lower disk is kept by the lower leg of the lever in such a way as to have a position symmetrical to the upper disk with regard to a line extending from the axis of the traction roller to the axis of rotation of the lever when the lever is in a median position of oscillation.

As will be easily understood, if the diameter of the upper disk is also identical to the diameter of the swivel roller, then this device of lever and oscillating disks gives the belt an intermitted forward movement, whose speed is rigorously identical to the one of the web of paper. If the diameter of the pulley and the traction roller are, in addition, identical, then the roller will feed the web exactly at the same speed, therefore, with a pre-established tension always constant. Alternatively, the diameter of the disk could be different to the diameter of the swivel roller, as the diameter of the pulleys and the traction rollers present the same difference in proportion.

If the spacing between the axis of the drive roller and the axis of the swivel roller is important, then the winding arc of the belt around the pulley of the traction roller could turn out to be too light to transmit an intermittent movement at a high rate and under a heavy load. The driving device is then completed at the level of the pulley of the traction roller by a back returning pulley and a reversing pulley, the symmetry between the two disks and between the pulley of the roller and the reversing pulley being realized with regard to a second line extending between the axis of the back pulley and the axis of the rotation of the lever.

Other advantages and features of the invention will be readily apparent from the following description of the preferred embodiments, the drawings and claims.

DESCRIPTION OF THE PREFERRED EMBODIMENTS

Figure 1:
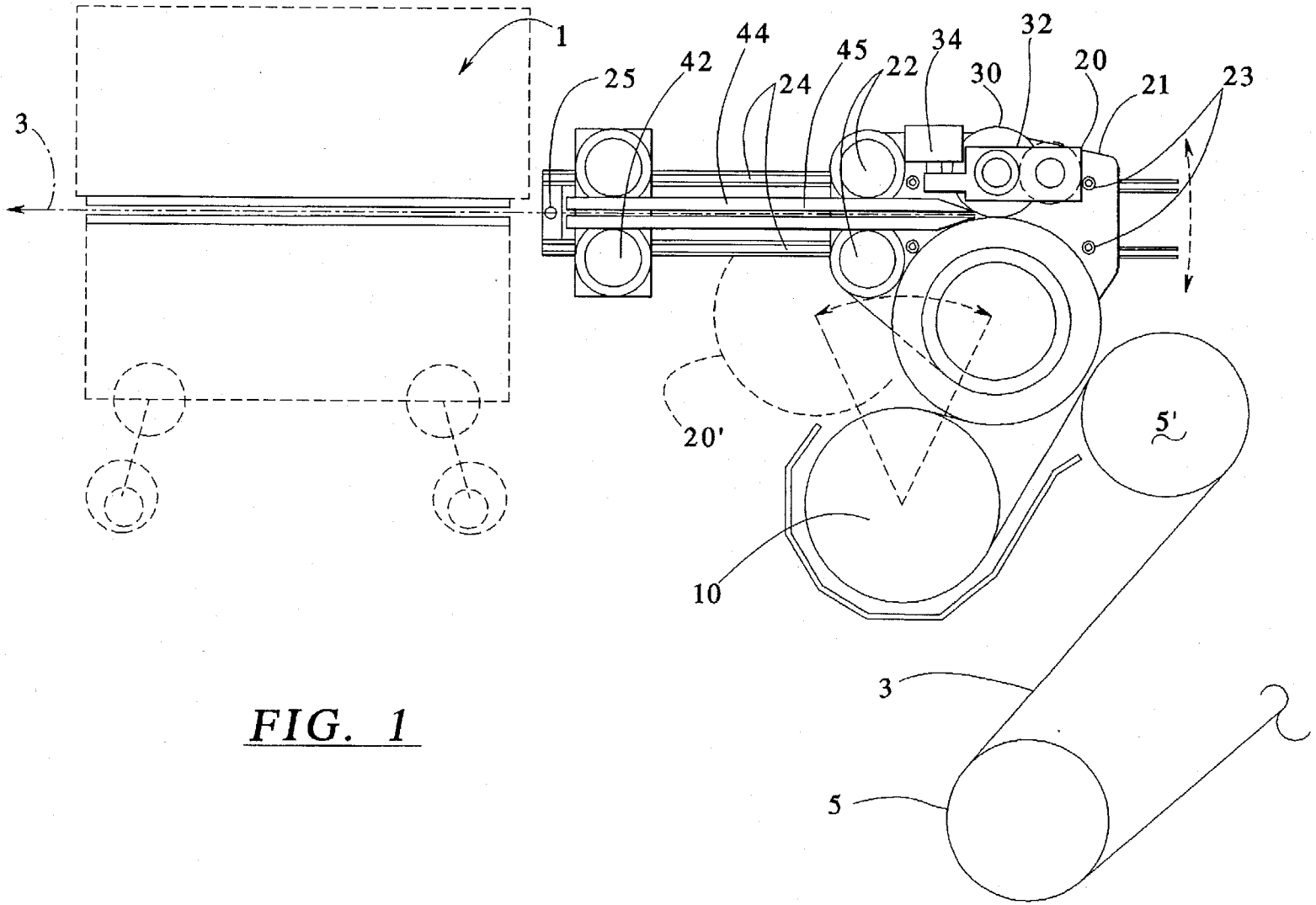
FIG. 1 is a schematic side view on a driving side of the feeding device according to the present invention.

The principles of the present invention are particularly useful in a device for sequentially feeding a continuous moving web 3 into a processing station 1, which station can be a platen press, which acts on the web during a dwell period in the advancement or movement of the web 3. The device includes a continuously rotating drive cylinder or roller 10 arranged to extend transverse to the direction of movement of the web and a swivel cylinder or roller 20 which rotates on an axis parallel to the axis of the drive roller 10 and oscillates from an upstream position illustrated in bold lines to a downstream position 20' shown in broken lines, with the movement being in substantially a horizontal plane. Under the circumstances, the running web 3 guided by leading rollers 5 and 5' passes under the drive cylinder 10 and engages between half and three-quarters of the periphery of the cylinder, depending on the position of the swivel roller 20. From the cylinder 10, the web wraps around the swivel roller, which is mounted for movement above the drive roller 10. The web, upon exiting contact with the swivel cylinder, is arranged at a level of the platen press 1. In this way, the upstream displacement of the swivel roller from the position 20' to the position 20 extends momentarily the last loop of the web, what will be increased when the platen press is in a working position and the web in the press is held stationary.

Figure 2:
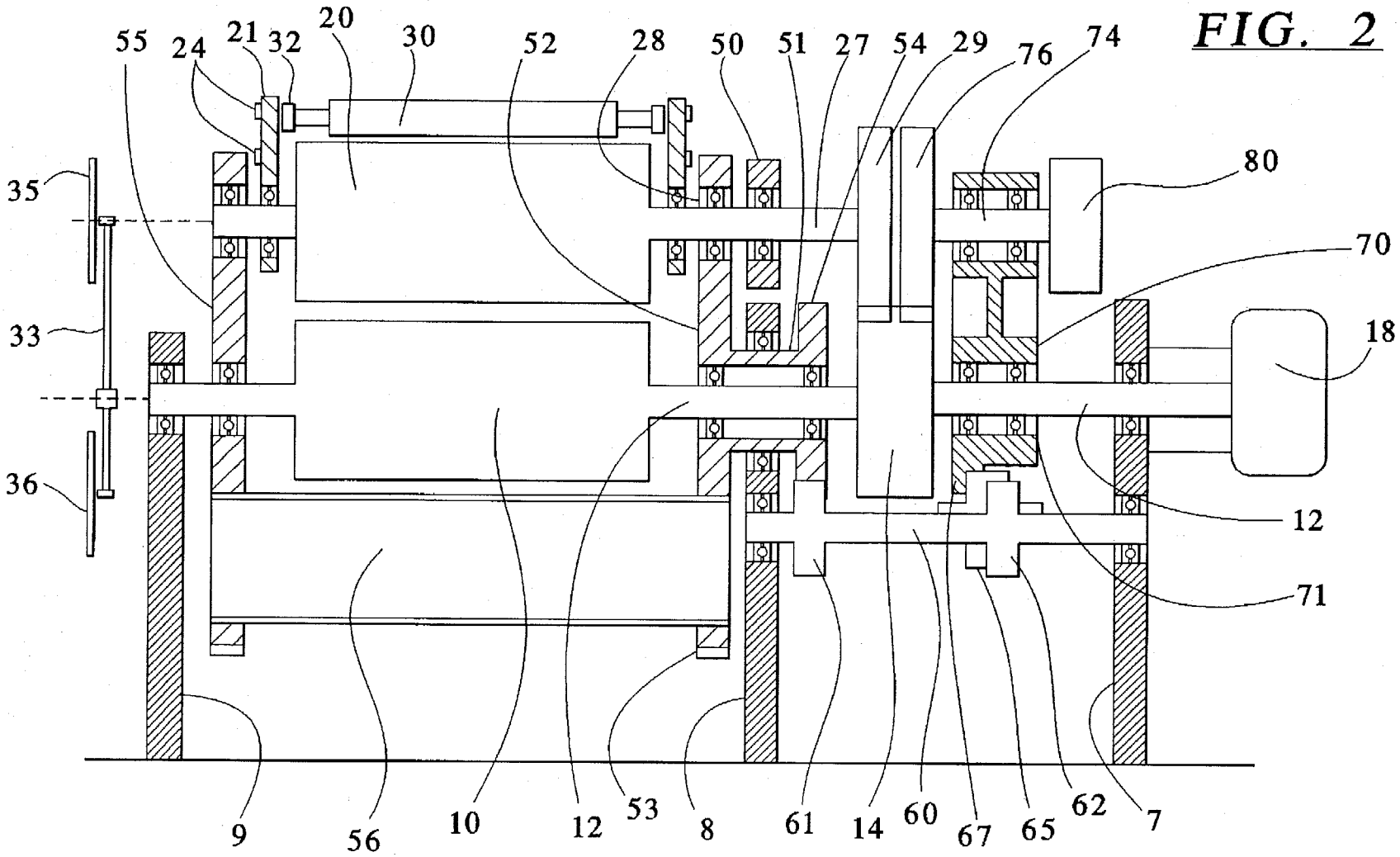
FIG. 2 is a schematic transverse cross sectional view of the feeding device of FIG. 1.
Figure 3:
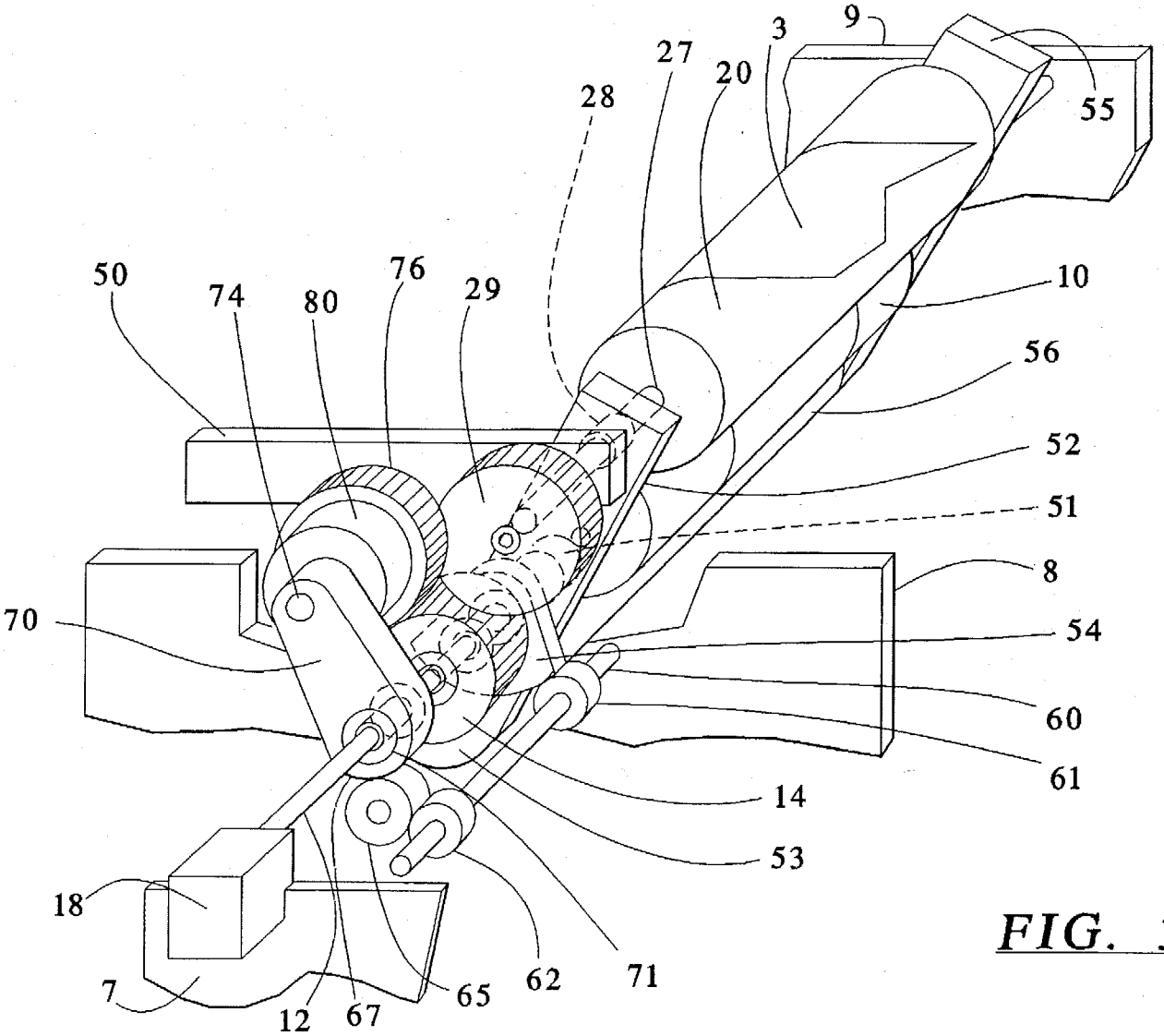
FIG. 3 is a schematic perspective view of the feeding device as seen from a side adjacent the drive motor.

With reference to FIGS. 2 and 3, the central axle 12 of the drive roller 10 is mounted in bearings in the right side walls 7, a central side wall 8 and a left side wall 9 of a frame. The walls 7 and 8 are close together and form a frame. The drive roller 10 is carried by a reducing motor 18, schematically illustrated on the wall 7, directly on an extension of the axle 12. A main toothed gear 14 is associated with the drive axle 12.

The central axle of rotation 27 of the swivel roller 20 is, for its part, supported by bearings 28 in the upper end of two levers 55 and 52, which levers 55 and 52 have a lower portion 53 and are mounted by bearings to rotate on the axle 12 of the drive roller 10. The lower legs 53 of these levers are rigidly joined and connected together by a cross member 56, which is of a light inertia and, thus, preferably is formed by a cylindrical member. The end of the axle 27 of the swivel roller 20 is associated with a pinion 29, which is meshing with the main toothed gear 14 and has an identical diameter therewith. Thus, a middle rotation speed of the drive roller 10 and the swivel roller 20 are rigorously identical.

A connecting rod 50 is coupled by means of a bearing onto the axle 27 of the swivel roller 20 and can shift the swivel roller cyclically from an upstream to a downstream position. The parallelism of the roller 20 with regard to the roller 10 is kept due to the structure of the legs 53 and the cross cylinder or member 56.

Just as it is, this sequential feeding device achieves an irregular driving torque and generates numerous vibrations, making it unusable at high rates of operation. That is why the device according to the present invention includes, among others, a counterweight 80 in the shape of a cylindrical mass fitted on a rotational axle 74, which is mounted by a bearing on an upper end of an oscillating arm 70. The arm 70 is mounted for rotation by a bearing 71 on the axle 12 of the drive roller 10. The axle 74 also has a counterweight pinion 76, which is meshed with the main toothed gear 14. The diameter of the pinion 76 is equal to the diameter of the main toothed gear 14 in such a way that the median rotation speed of the counterweight 80 is identical with the one of the swivel roller 20.

As illustrated in FIGS. 2 and 3, the lever 52 with the extension 53 has a cylindrical hub 51, which is mounted by bearings in the central wall 8 and contains bearings for supporting the axle 12. The hub 51 is completed at the other end, i.e., between the walls 7 and 8, by a toothed segment gear 54 of a circular sector adjusted on the rotational axle 12 of the drive cylinder 10. This toothed segment 54 is meshed with a first idling gear 61 associated with an idling axle 60, which is mounted by bearings for rotation in the walls 7 and 8. A second idling gear 62 is associated with the axle 60 and is meshed with a reversing gear 65, whose rotational axis is also kept in each end by bearings extending in the walls 7 and 8 of the frame. The reversing gear 65 is also geared with a toothed sector 67 on the arm 70, and this sector 67 is adjusted on the bearing 71 of the arm. This mechanical transmission provides an oscillation of the arm 70 in rotation in an opposite direction to the movement of the levers 55 and 52.

With reference to FIG. 3, when the drive roller 10, as well as the main toothed gear 14, turn in a counter-clockwise direction, the swivel roller 20, which has the pinion 29, will rotate in a clockwise direction. The same cylindrical counterweight 80 carried by its pinion 76 will turn in a clockwise direction as well.

If the connecting rod 50 is pulled upstream, that is to say to the left in FIG. 3, the pinion 29 runs momentarily in a counter-clockwise direction along the main toothed gear 14, and during this movement provokes a fall or decrease in the drive torque consumed by the swivel roller 20. However, simultaneously, the rotating arm 70, carried by the mechanism 54, 60–65, turns in a clockwise direction, which creates the running of the pinion 76 in the same direction along the main toothed gear 14, which will momentarily increase the drive torque consumed by the counterweight 80. Since this counterweight 80 is dimensioned in such a way that its moment of inertia with regard to its center of rotation and with regard to the axle 12 of the drive roller 10 is identical with the corresponding moment of inertia of the swivel roller 20, a compensation of the momentary variations of the torque making the charge of the reduction motor 18 on the axle 12, while important, is rigorously constant and allows the use of electrical motors, particularly performant as a brushless type.

Since it is possible to dimension the mass and the inertia of the counterweight 80 in an independent manner, the counterweight will be dimensioned in mass so as to counterbalance the effect of the mass of the swivel roller system. This counterbalance is in a horizontal plane and for the parts near the wall 8 of the frame.

Moreover, the traction of the connecting rod 50 on the axle 27 of the swivel roller 20 reacts at a level of the rotational hub or cylinder 51 in the central wall 8 of the frame, and in a similar manner, at the level of the side wall 9. However, the evolution of this traction force is balanced by the simultaneous downstream swinging of the counterweight 80 in the same horizontal plane as the one of the movement of the swivel roller 20. A similar attenuation is developed at the downstream return of the swivel roller.

In order to ensure a position rigorously exact for the web in the processing station, it is important that the position of the web is kept permanently in a correct manner all along the feeding device and more particularly in the travel path situated between the swivel roller 20 and the entry to the station 1 when the loop in arrears is decreasing at the introduction of a new part of the web into the station.

To this aim, and according to a first realization mode of the device of the feeding web from the swivel roller to the processing station as visualized in FIG. 1, a pressure roller 30 is used and acts at the output of the swivel roller 20 in order to push effectively the web forward at a feeding sequence. The pressure roller 30 acts in combination with a double telescopic guiding tablet which is composed of upper and lower combs having a stationary portion 44 between which a pair of movable lower and upper upstream combs 45 will oscillate.

As better illustrated in FIGS. 1 and 2, two lateral plates 21 are mounted for rotation around the axle 27 of the swivel roller 20. These plates have wheels 23, which are engaged in guiding rails 24, which are mounted for rotation around a point 25 at the downstream end, which is near the platen press 1. On the inner or inner surfaces of each of the plates, a horizontal lever 32 is mounted, and the upstream end is kept by an axle of rotation and the downstream end is kept by a remote-controlled cylinder 34. The pressure roller 30 is mounted for rotation on these two levers. Like this, the pressure of the roller 30 against the swivel roller 20 can be adjusted by means of the cylinder 34.

The lateral plates 21 are guided by the rails 24 interconnected by two cross tubes 22 which mount the upper and lower downstream oscillating comb 45 in an extension of the stationary comb 44, which is mounted by cross tubes or supports 42 on the same rails 24. Like this, at the movement of the swivel roller 20 around the drive cylinder or roller 10, the lateral plates stay always correctly adjusted along the rails 24, and it is the same for the combs constituting a double guiding table for the web of paper travelling at a very high speed for introduction into the platen press 1. Guided in this manner, the web 3 stays flat and keeps its registry.

Figure 4B:
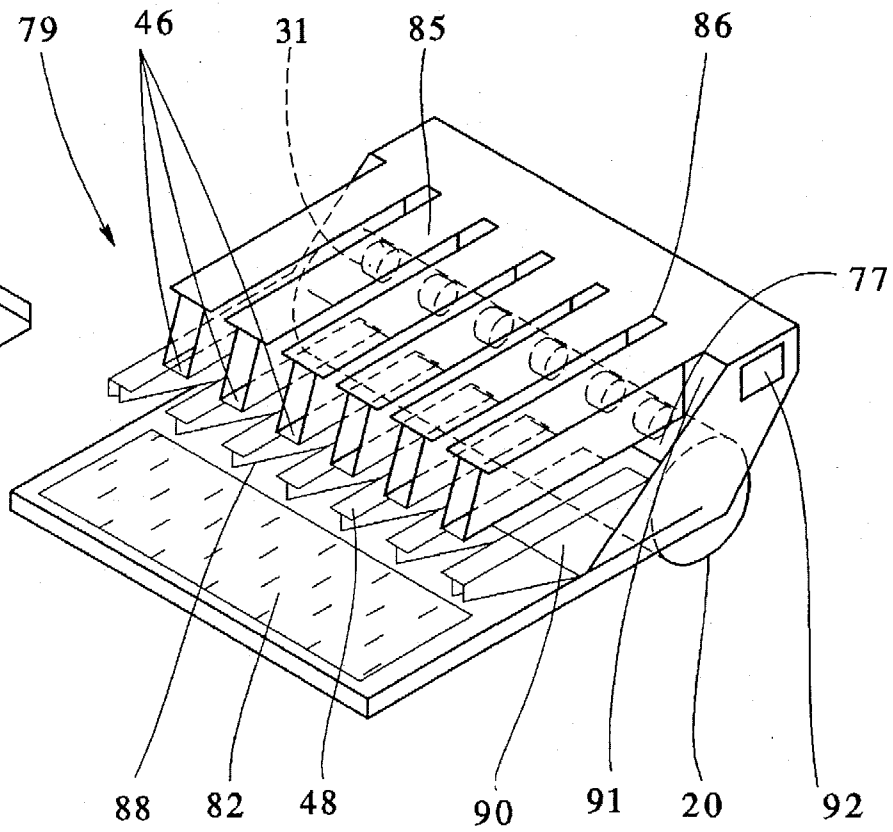
FIGS. 4A and 4B are schematic perspective views of two separated enveloping half-boxes for a guiding table with FIG. 4A being of a downstream half-box which is partially rotated relative to an upstream half-box of FIG. 4B.
Figure 4A:
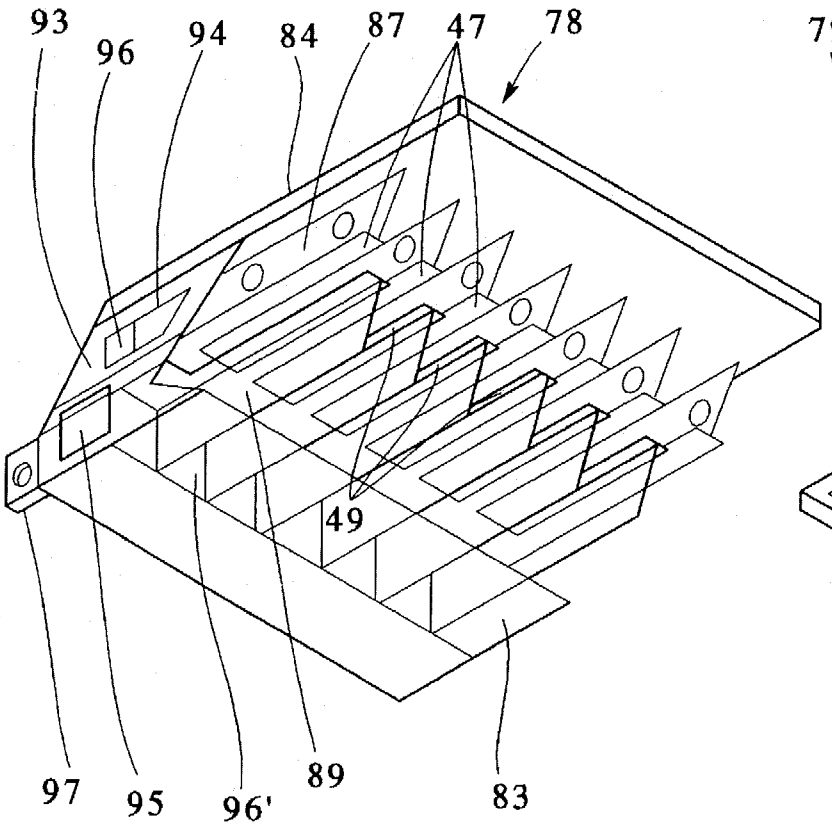
Figure 5:
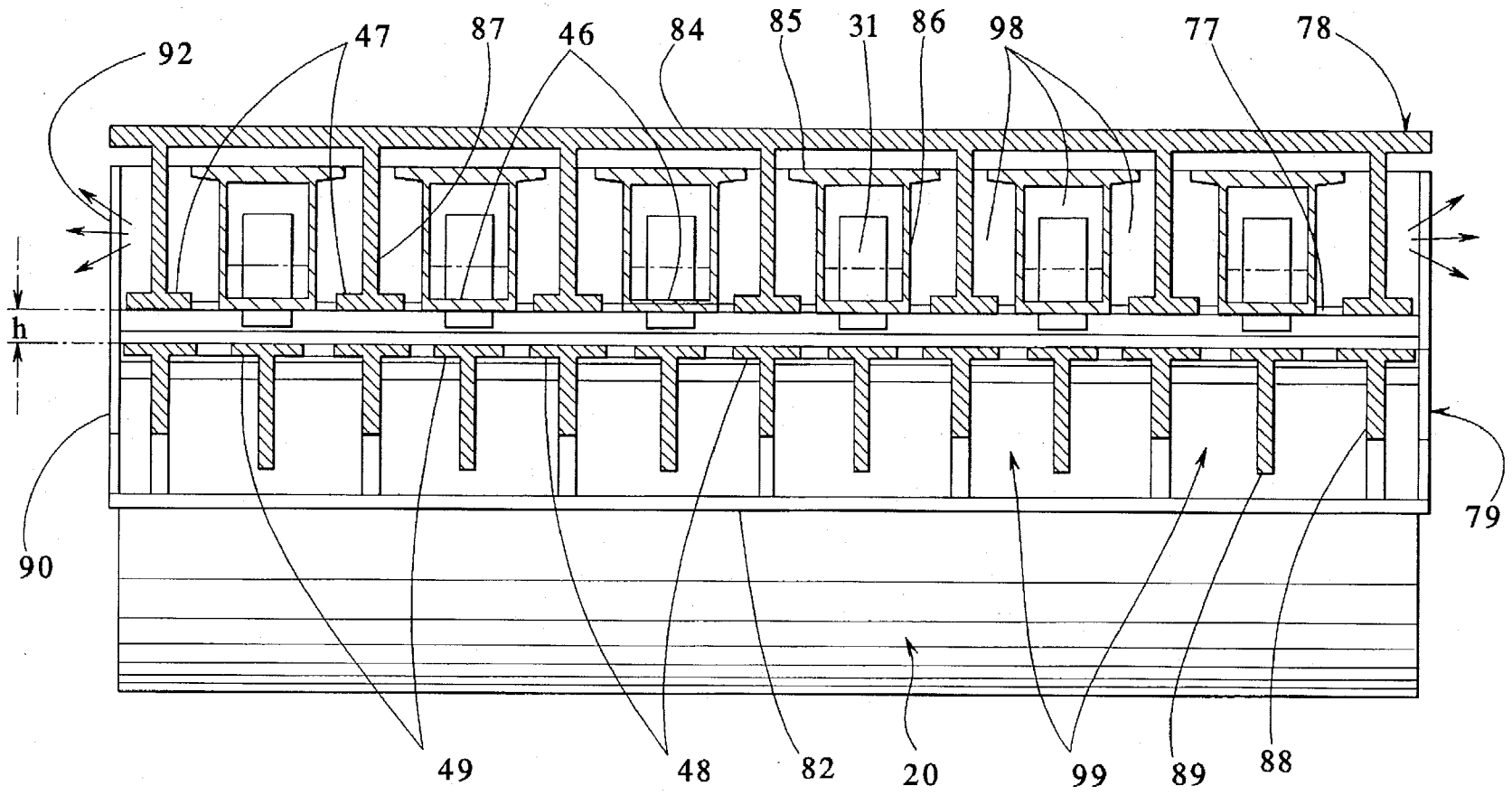
FIG. 5 is a schematic cross sectional view taken along the lines V—V of FIG. 4 for the assembled telescopic tables.

The first realized mode for controlling the combs of the double telescopic table is illustrated in FIGS. 4A, 4B and 5 and uses two half-boxes 78 (FIG.4A) is and 79. One box 78 is an almost stationary downstream box connected by fasteners 97 for rotation either at a fixed point near the entry of the machine or directly to the lower platen if the run is light. The second box 79 FIG. 4B, which oscillates with the swivel roller 20, partially surrounds the roller 20 and is connected on the axle 27 of the tables to pivot therearound. These two half-boxes are then connected together by rails for a lengthwise sliding motion (which is not illustrated).

The downstream box 78 presents an important primary ceiling 84 connected at its downstream end to two small side walls 93 of a length that is between one-quarter and one-fifth of the length of the ceiling 84. The side walls are connected themselves to a secondary bottom 83 of a length comprising between one-third and one-quarter of the length of the ceiling 84.

A plurality of vertical lengthwise metallic plates 87 descend from the lower surface of the ceiling 84, and the plates 87 are attached to a horizontal metal plate 47, which has a plurality of parallel slots to form a comb-shaped member. Each of the teeth of the comb-shaped member 47 has a plurality of slots that extend approximately half the length of the member into the member to form a base which is about half of the length. The teeth are connected to the members or plates 87 to form a substantially inverted tee adjacent the outer end. On the other end, the vertical plates 87 do not cover the entire length of the upper ceiling 84 and are spaced from the back end or wall by a distance of one-tenth of the ceiling length in order to create an upper crosswise or transverse chamber 96, which opens on both sides on the upper side wall windows 94 arranged in each of the side walls 93. These side plates 93 end at the area of the teeth eventually by an oblique vertical border.

A plurality of vertical lengthwise metallic plates 89 emerge from the upper surface of the bottom 83, as well, and each plate 89 carries a tooth of a lower downstream comb 49, which is also a horizontal plate having slots extending inward from one end to form a comb. The lower teeth 49 are of the same spacing as the upper teeth, but are offset sidewise by a half-spacing, as best illustrated in FIG. 5. In a similar manner, on the upper part, these teeth are starting from the upper border of a vertical cross half-wall of the lower end, whose lower border is connected to a corresponding border of the secondary bottom 83 and end somewhat in the background of the upper teeth. The vertical plates are starting at a distance from the back wall in order to create a lower cross chamber 96' opening on both sides on lower side wall windows 95 of the side walls 93.

In another way, the upstream half-box 79 has an important primary bottom 82, which may be glazed, and has, on each side, side walls 90 which extend obliquely upstream, except for a triangular downstream advance, and these walls are themselves connected to a secondary ceiling 85 presenting a series of lengthwise slots corresponding with the upper vertical members 87 of the downstream half-box 78. The upper faces of the primary bottom 82 of the upstream half-box 79 is at the level of the lower surface respectively of the secondary bottom 83 of the downstream half-box 78 and the upper surface of the secondary ceiling 85 of the upstream half-box is at the level of the lower surface of the primary ceiling 84 of the downstream half-box 78 so that surface contact can be maintained while the half-boxes move on the rail and provide a sliding motion therebetween.

A plurality of tubular structures 86 descend from the lower surface of the ceiling 85, with a lower horizontal surface of these structures constituting teeth 46 of the upper upstream comb. The upstream ends of the lower surfaces of the teeth are connected together by an intermediate horizontal transverse plate 77, whose upstream end adjoins a vertical transverse half-wall or back wall of the upper end, the upper border of the half-wall being connected to the secondary ceiling 85. The upstream end of the tubular structures are still ending before the half-wall or back wall of the transverse end in order to create another transverse chamber which opens on windows 92 on each of the side walls 90.

The primary bottom 82 ends upstream at the level of the swivel roller 20 in an oblique plate kept by side walls 90, the oblique plate having a triangular rib 88 for supporting the teeth of the lower upstream comb 48 at the beginning. The teeth present here are in the shape of horizontal extending plates arranged sidewise between two upper tubular structures 86.

In addition, a series of pressure rollers 31 are installed, with one each for each of the tubular structures 86 at the point of the horizontal intermediate plate 77, and these pressure rollers correspond to the pressure roller 30. Thus, the web 3 is held against a surface of the swivel roller 20 by these pressure rollers 31.

In FIG. 5, two half-boxes are shown relative to each other, with parts of the upstream half-box 79 being cross-hatched with fine lines and parts of the downstream half-box 78 being cross-hatched with a thicker line to determine which is which. As will be easily established, the lower teeth 48 and 49 being side-by-side again constitute, first, a lower table which is interposed below the upper table formed by the teeth 46 and 47, with the teeth being spaced apart by a slight height h to create a passage for the web. This distance h meets, again, between the transverse half-walls of the upper and lower ends of the downstream half-box 78 as well.

The lower plates 88 and 89 create a lower lengthwise telescopic chamber 99, and the upper plates 87 coupled with the tubular structures 86 create an upper lengthwise telescopic horizontal chamber 98. These chambers create a horizontal flow on the ambient air which is stirred up by the oscillating movement of the half-box and the flow can exit or leave sidewise through the windows 92, 94 and 95. Thus, a vertical air flow, which is capable of urging the web against one of the upper or lower tables, is practically annihilated in this design.

Figure 6:
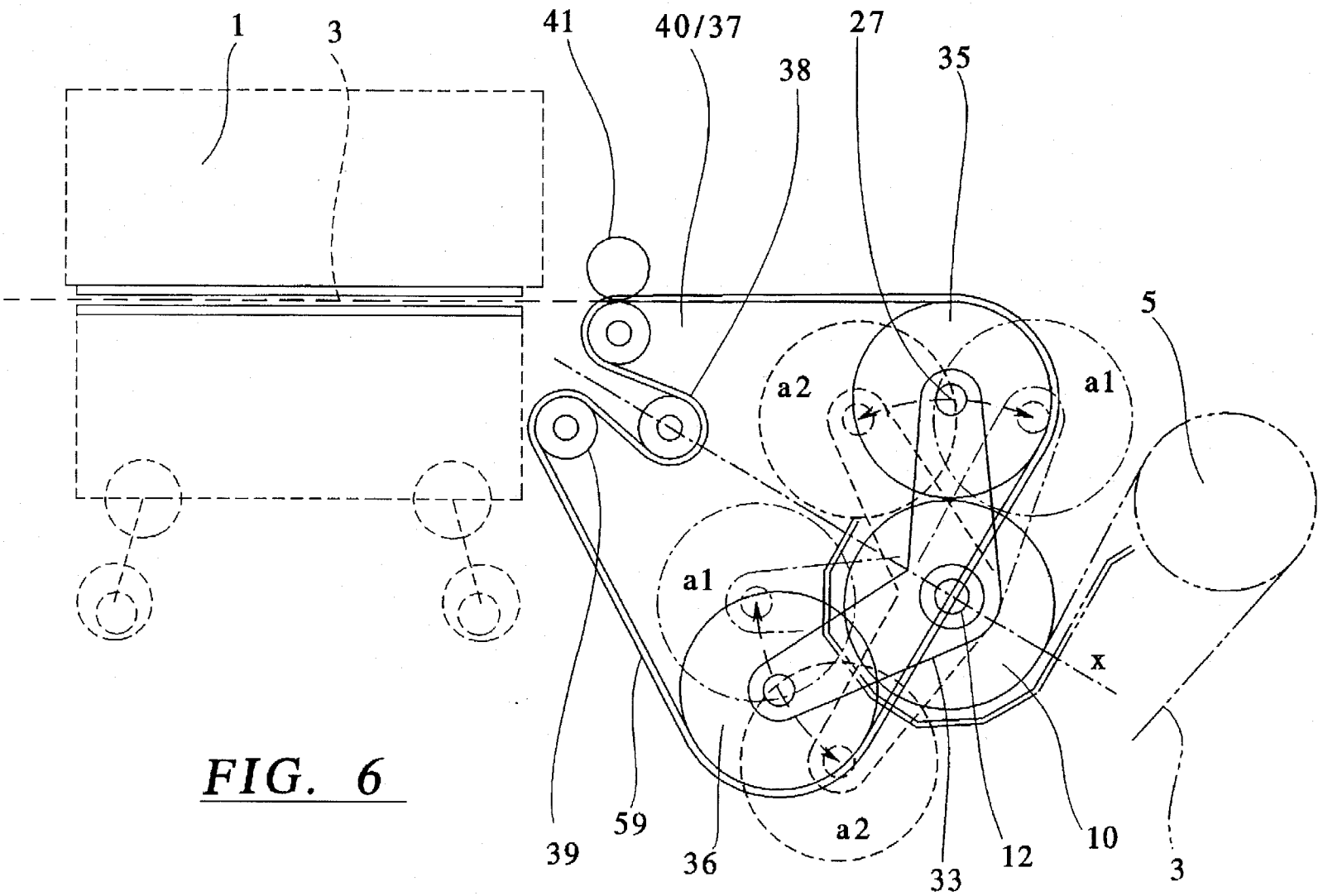
FIG. 6 is a schematic view from a driving side of a driving device for the traction roller coupled with the feeding device according to the present invention.

A second realized modification of the device for leading the web from the swivel roller to the processing station is shown in FIG. 6. The keeping of the correct position of the web is only secured by a pair of traction rollers 40 and 41 carried in an intermittent manner in such a way that their peripheral speed would be practically identical to the intermittent speed of the web, which will allow a permanently applied light constant traction on the web 3 leaving the swivel roller 20.

The intermittent driving of the lower traction roller 40 could be realized by means of an electric speed-modulated motor. However, at the envisioned rate of feed, the control of such a motor would be delicate and would necessarily pass by a speed order slightly higher involving a variable slipping capable to damage the surface of the web. A mechanical intermittent driving based on cams could be envisioned as well. However, such a mechanism turns out to be difficult as well, is voluminous and expensive. Moreover, it will induce great modulations in the general drive torque of the machine, which is precisely the opposite of what the present device is directed to do. Preferably within the scope of the invention, the driving of the swivel roller is used to account for a differential secondary driving of the traction roller 40, as illustrated in FIG. 6, and partially on the left pan of FIG. 2.

First, the driving arrangement has a vertically bent lever 33 arranged on an external surface of the wall 9 on the driving side and mounted for free rotation on an extension of the driving axle 12 of the drive roller 10. The end of the upper leg perceptibly vertical to the lever is crossed by an extension of the driving axle 27 of the swivel roller to impart an oscillating motion to this lever 33. A first upper disk 35 is mounted on the end of the axle 27, that is to say at the level of the end of the upper leg of the lever 33. This disk will be moved or rotated at the same angular speed as the swivel roller. The end of the lower leg, which extends obliquely downstream of the lever 33, carries a second lower disk 36, whose diameter is identical to the upper disk 35.

The driving comprises, then, a driving pulley 37 mounted to the end of the axle of the traction roller 40 and arranged on the external surface of the wall 9 in the same vertical plane as the disks 35 and 36. This allows the installation of an endless belt 59 to pass around these disks and pulleys. In order to be able to secure a sufficient winding arc of the belt around the pulley 37, a back or idler pulley 38 and a reverse pulley 39 are provided and the belt passes around these, as illustrated.

As shown in FIG. 6, the angle of the lever 33 and the arrangement of the pulley 39 are such that the belt 59 presents a symmetry with regard to a line x, which connects the axis of rotation of the axle 12 of the lever and the axis of rotation of the back pulley 38 when the upper leg of the lever 39 is in a vertical direction, that is to say in the median position of oscillation. When the swivel roller and upper disk 39 are drawn back to a position al, the increase of the upper horizontal length of the run of the belt 59 is counterbalanced by a reduction of an equal value of the run between the reverse pulley 39 and the lower disk 36, which has moved to its position a1. An opposite effect appears at the forward moving of the disk 35 to the position a2 involving the return o the lower disk 36. Owing to this arrangement, the length of the runs stay practically constant, the small variations being absorbed easily by the elasticity of the belt.

If the diameter of the disk 35 is equal to one of the diameter of the swivel roller 20 on which it is directly connected, and that the diameter of the pulley 37 is equal to the diameter of the traction roller 40 to which it is directly connected as well so that it will be constated that the speed and the intermittent acceleration and removal of the belt 59 between the disk 35 and the pulley 37 is identical with the one of the web 3 and also with the peripheral speed of the traction roller 40. Then, the roller 40 is effectively pulling the web at the right moment, and this would be under a pre-established constant tension. In practice, the diameter of the disk 35 can be different from the one of the roller 20, as much as the difference between the diameters of the pulley 37 and the roller 40. It should be observed that the counterweight 80 would be then redimensioned in order to balance the supplementary inertias of the rollers 40, 41 as well.

If this second realized modification of leading the web into the processing station seems to be lighter in weight and hence less inert than the first one using pressure cylinders and telescopic tables, both could be obviously coupled in order to perfect the control of the web. It should be observed that the roller 10 could be replaced by an extension of the axle 60 to the frame 9 and the adjunction of an arrangement of toothed pinion/segment analogous to the element numbers 61/54 on the lever 52 and the roller 10 and the extended axle 30 have each specific advantages in practice.

Although various minor modifications may be suggested by those versed in the art, it should be understood that I wish to embody within the scope of the patent granted hereon all such modifications as reasonably and properly come within the scope of my contribution to the art.

I claim:

1. In a feeding device for advancing a web into an input of a station which, during a standstill of the web, processes the web, said device including a first drive roller around which a second swivel roller being moved upstream and downstream positions, said swivel roller being mounted by two side levers to pivot on an axle of the drive roller, and having a driving pinion meshing with a drive gear on the axle of the drive roller, and means for moving the swivel roller upstream to form a loop in the web when the web is at a standstill in the station, the improvements comprising a counterweight having a pinion meshing with a toothed gear on the axle of the drive roller, said counterweight being mounted for rotation on a center of rotation on a pivot arm, said pivot arm mounted for pivoting around the axle of the drive roller, and means for oscillating said pivot arm with the counterweight on the axle of the drive roller in a direction opposite to the movement of the swivel roller.

2. In a feeding device according to claim 1, wherein the pinion of the counterweight is of an identical diameter to the diameter of the gear on the axle of the drive roller, and the mass of said counterweight is selected so that the moment of inertia with regard to an axis of the center of rotation and with regard to the axle of the drive roller are identical to a moment of inertia of the swivel roller.

3. In a feeding device according to claim 2, wherein the means for oscillating the pivot arm and the counterweight include a lever for mounting the swivel axis having a toothed segment of a circular sector engaging a first gear associated with a reversing axle extending parallel to the axle of the drive roller, said reversing axle having a second gear being meshed with a reversing gear which in turn is meshing with a toothed circular sector connected to the pivot arm carrying the counterweight.

4. In a feeding device according to claim 3, wherein the swivel roller is arranged above the drive cylinder and oscillates along a horizontal plane and the counterweight oscillates along the same horizontal plane as the swivel roller.

5. In a feeding device according to claim 4, which includes means for applying pressure on the web adjacent the exit of the web from the swivel roller to hold the web against the swivel roller, said means including at least one pressure roller, means mounting the pressure roller adjacent the exit of the path of the web from the swivel roller, and means for urging the pressure roller at a desired pressure against the swivel roller.

6. In a feeding device according to claim 5, wherein the swivel roller is mounted between two lateral plates, the pressure roller is mounted for rotation between two lateral levers, said levers being mounted for rotation on the lateral plates and the means for urging comprising a cylinder acting on said levers with a predetermined pressure force.

7. In a feeding device according to claim 4, which includes telescopic tables forming a path for the web leaving the swivel roller to the input of the station for processing the web, said telescopic tables including a downstream horizontal comb arrangement substantially stationarily arranged at the input to the processing station and having an upper comb and a lower comb, an upstream pair of combs including an upper comb and a lower comb being mounted to move with the swivel roller and telescopically received with the downstream comb so that the length of the table changes as the swivel roller moves between the upstream position and downstream positions.

8. In a feeding device according to claim 7, wherein the downstream combs are mounted on an upper crossbar and a lower crossbar associated with a pair of side rails, whose downstream ends are mounted for rotation near the input of the processing station, the swivel roller including a pair of lateral plates having external rollers received in said lateral rail, said lateral plates being spaced apart by a pair of crossbars, said crossbars mounting the upstream combs for movement with the swivel roller.

9. In a feeding device according to claim 7, wherein the upstream and downstream combs comprise two half-boxes, the downstream combs being mounted to pivot around an axis at the entrance of the processing station and the upstream combs being connected to move with the axle of the swivel roller, teeth of the lower combs being support individually by vertical plates merging at right angles to the bottom wall of the half-box, teeth of the upper combs being supported by vertically extending structures descending from the top wall of each half-box, said structures and vertical plates forming crosswise chambers adjacent a rear wall of each of the half-boxes, said chambers being in communication with windows in sides of each half-box.

10. In a feeding device according to claim 4, which includes a pair of a traction roller mounted near the input to the station.

11. In a feeding device according to claim 10, wherein a drive device for one of the traction rollers comprises a belt passing around a pulley associated with the one traction roller and around two disks having the same dimension and arranged on two legs of a vertical lever mounted for rotation on the axle of the drive roller, the upper disk being mounted on the axle of the swivel roller, which axle is coupled to the lever so that the lever oscillates with the swivel roller, the lower disk being kept by a lower leg of the lever in such way as to have a symmetrical position to the upper disk with regard to a line connecting the axis of the traction roller to the axis of rotation of the lever when the swivel roller is in a middle position of oscillation.

12. In a feeding device according to claim 11, wherein the drive device for the one traction roller includes a return back pulley and a reversing pulley, the symmetry between the first and second disks and between the pulley of the traction roller and reversing pulley being realized with regard to a line connecting the axis of the back pulley and the axis of rotation for the drive roller.

* * * * *